US007955088B2

(12) United States Patent
Di Stefano

(10) Patent No.: US 7,955,088 B2
(45) Date of Patent: Jun. 7, 2011

(54) AXIALLY COMPLIANT MICROELECTRONIC CONTACTOR

(75) Inventor: Thomas H. Di Stefano, Monte Sereno, CA (US)

(73) Assignee: Centipede Systems, Inc., San Jose, CA (US)

( * ) Notice: Subject to any disclaimer, the term of this patent is extended or adjusted under 35 U.S.C. 154(b) by 0 days.

(21) Appl. No.: 12/764,915

(22) Filed: Apr. 21, 2010

(65) Prior Publication Data

US 2010/0273364 A1 Oct. 28, 2010

Related U.S. Application Data

(60) Provisional application No. 61/171,817, filed on Apr. 22, 2009.

(51) Int. Cl.
*H01R 12/00* (2006.01)

(52) U.S. Cl. ..... 439/66; 439/81; 439/82; 439/750

(58) Field of Classification Search ..... 439/66, 439/81, 82

See application file for complete search history.

(56) References Cited

U.S. PATENT DOCUMENTS

| | | | | | |
|---|---|---|---|---|---|
| 2,490,317 | A * | 12/1949 | Ostrak | 439/843 |
| 5,259,781 | A * | 11/1993 | Baumberger et al. | 439/66 |
| D372,222 | S * | 7/1996 | Matthews | D13/154 |
| 5,928,000 | A * | 7/1999 | Rudisill et al. | 439/63 |
| 6,264,476 | B1 * | 7/2001 | Li et al. | 439/66 |
| 6,444,913 | B1 * | 9/2002 | Kao | 174/73.1 |
| 6,471,525 | B1 * | 10/2002 | Fan et al. | 439/70 |
| 6,524,115 | B1 * | 2/2003 | Gates et al. | 439/66 |
| 7,442,045 | B1 * | 10/2008 | Di Stefano | 439/66 |
| 7,491,069 | B1 * | 2/2009 | Di Stefano et al. | 439/74 |
| 2002/0153976 | A1 * | 10/2002 | Pluymers | 333/246 |
| 2004/0106327 | A1 * | 6/2004 | Baker | 439/654 |

* cited by examiner

*Primary Examiner* — Briggitte R Hammond
(74) *Attorney, Agent, or Firm* — Michael B. Einschlag

(57) ABSTRACT

One embodiment is an axially compliant electrical contactor for interconnecting microelectronic devices, the contactor including: an insulative sleeve having a hole therethrough; and a metal tube having a cylindrical wall being slidably disposed in the hole; wherein: (a) two or more elongated slots through the cylindrical wall extend from a first circumferential collar of the tube to a second circumferential collar of the tube; (b) the two or more slots form two or more elongated resilient legs connecting the first collar and the second collar; and (c) a portion of each elongated leg is disposed in the hole.

4 Claims, 4 Drawing Sheets

AXIALLY COMPLIANT MICROELECTRONIC CONTACTOR

This patent application relates to U.S. Provisional Application No. 61/171,817 filed Apr. 22, 2009 from which priority is claimed under 35 USC §119(e), and which provisional application is incorporated herein in its entirety.

TECHNICAL FIELD OF THE INVENTION

One or more embodiments of the present invention relate to contactors used for making connections to devices such as, for example and without limitation, microelectronic devices. In particular, one or more embodiments of the present invention relate to controlled force contactors used for testing and burning-in microelectronic devices. In further particular, one or more embodiments of the present invention relate to a compliant cylindrical metal contactor for making electrical connections to high performance microelectronic devices such as, for example, and without limitation, integrated circuits ("ICs"), semiconductor wafers, wafer probe cards, circuit boards, cables, microprocessor chips and RAM memories.

BACKGROUND

Contactors including sockets, probes, spring pins and interposers are routinely used in systems for: (a) testing electronic device performance (an assortment of socket types has been developed to connect to a device under test ("DUT") having a wide variety of terminals and configurations), or (b) burning-in electronic devices at elevated temperatures. Miniature contactors are used widely in such sockets to make contact to terminals on microelectronic devices. For example, a socket used for test or burn-in applications will typically have contactors with mechanical compliance that accommodates imperfections in a DUT as well as warping and non-planarity of a printed circuit board to which the socket is attached.

Prior art sockets are differentiated typically according to the type of terminals on a DUT, and according to an intended end use (i.e., application). For example, contactors used in sockets are typically designed to make electrical connection to terminals on microelectronic devices wherein the types of device terminals contacted by sockets include pin grid arrays ("PGAs"), J-leads, gull-wing leads, dual in-line ("DIP") leads, ball grid arrays ("BGAs" such as, for example, a two dimensional array of solder bump terminals on a microelectronic device), column grid arrays ("CGAs"), flat metal pads (sometimes referred to as land grid arrays ("LGAs")), and many others. Many contactor technologies have been developed to provide sockets for microelectronic devices having this variety of terminals.

In addition to the foregoing, further differentiation among prior art sockets refers to low insertion force ("LIF") sockets, zero insertion force ("ZIF") sockets, auto-load sockets, burn-in sockets, high performance test sockets, and production sockets (i.e., sockets for use in products). In further addition to the foregoing, low cost prior art sockets for burn-in and product applications typically incorporate contactors of stamped and formed springs to contact terminals on a DUT. In still further addition to the foregoing, for high pin-count prior art sockets, a cam is often used to urge device terminals laterally against corresponding contactors to make good contact to each spring while allowing a low or zero insertion force.

For specialized applications, prior art sockets have used a wide variety of contactors, including anisotropic conductive sheets, metal filled elastomeric buttons, flat springs, lithographically formed springs, fuzz buttons (available from Cinch, Inc. of Lombard, Ill.), spring wires, buckling beams, barrel connectors, and spring forks, among others. Prior art sockets intended for applications where many test mating cycles (also referred to as socket mount-demount cycles) are required typically use spring pin contactors of the type exemplified by Pogo® spring contacts (available from Everett Charles Technologies of Pomona, Calif.).

Spring probes for applications in the electronics test industry are available in many configurations, including simple pins and coaxially grounded pins. Most prior art spring probes consist of a coil spring disposed between a first post (for contacting terminals on the DUT) and a second post (for contacting contacts on a circuit board—a device under test board or "DUT board"). Spring probes are designed typically to undergo about 500,000 insertions before failure.

Spring probe contactors of the prior art provide reliable, high performance contact to terminals on many types of microelectronic device. A continuing increase in areal density of terminals has driven terminal spacing down below 0.4 mm, thereby increasing the cost and complexity of spring probe contactors. In particular, spring probes are typically made by a manual procedure wherein: (a) a miniature post is inserted into a sleeve; and (b) a spring and a second post are then inserted and crimped in place. This manual procedure becomes more difficult and expensive for the small contactors required for terminal spacing below 0.4 mm. Further, attempts to simplify spring probes by using only a coil spring as the contactor have largely failed. In a spring pin of the Pogo® type, the moving post must make good contact with the conductive sleeve to avoid signal current's passing through the coil and producing undesirable inductance and resistance. A coil spring at such small dimensions has too high an electrical resistance and inductance to be useful for any but the least demanding socket applications.

Spring probe contactors typically have a plurality of spring pin contactors disposed in an array of apertures formed through a dielectric holder. By way of example, a high performance, prior art test socket may incorporate a plurality of Pogo® spring contacts, each of which is held in a pin holder with an array of holes through a thin dielectric plate. The dielectric material in a high performance, prior art test socket is typically selected from a group of dimensionally stable polymer materials including: glass reinforced Torlon 5530 (available from Quadrant Engineering Plastic Products, Inc. of Reading, Pa.); Vespel; Ultem 2000 (available from GE Company GE Plastics of Pittsfield, Mass.); polyether ether ketone (PEEK); liquid crystal polymer; and others. The individual Pogo® spring contacts are typically selected and designed for signal conduction at an impedance level of approximately fifty (50) ohms.

The recent growth in use of BGA terminals for integrated circuit ("IC") packaging has resulted in use of new and varied sockets adapted to the BGA terminals for increasing terminal count and area density. BGA sockets have evolved in several directions. One type involves use of a cam driven spring wire to contact the side of each ball on a BGA package. Another type involves use of spring pins or Pogo® spring contacts that have been adapted for use in BGA sockets for certain applications in which the high cost of the socket is acceptable.

Low-cost sockets for mass market applications have evolved the use of stamped and formed spring contactors that cradle each ball of the BGA and provide some measure of mechanical compliance needed to urge a spring connector into contact with a mating ball. Variations of stamped and formed springs are configured to use two or more formed springs to grip each ball, and thereby, to make positive electrical contact while retaining the ball mechanically. Miniaturization and density of mechanically stamped and formed springs are limited by present capabilities to a certain minimum size. As such, sockets with such contactors are limited in density by the complexity of stamping and forming very small miniaturized springs. Further, the mechanical compliance of a stamped and formed spring is typically small in a vertical direction perpendicular to a substrate of a ball contact. Because of small compliance in a vertical direction, a miniature stamped and formed spring may be unable to accommodate motion of a contactor support relative to a ball mated to it, thereby allowing vibration, mechanical shock load and forces, flexure, and the like to cause the connector to slide over the surface of the ball and potentially lose contact.

Many prior art sockets are intended to provide reliable and repeatable electrical contact to electrical terminals without causing damage to either. As such, the contactors of the socket must provide a low resistance connection to mating terminals over repeated insertions of devices. A continuing increase in the areal density of terminals on high performance microelectronic devices increases the difficulty and cost of providing reliable contactors.

SUMMARY

One or more embodiments of the present invention, solve one or more of the above-identified issues. In accordance with one or more embodiments of the present invention, an electrical contactor, for example, a miniature electrical contactor is provided for making electrical connection between mating terminals including for example and without limitation, a bump (a solder bump) of a ball grid array ("BGA"), a contact pad of a land grid array ("LGA"), and a flat electrical contact on a microelectronic device. In particular, in accordance with one or more embodiments, a contactor comprises: an insulative sleeve having a hole therethrough; and a metal tube having a cylindrical wall being slidably disposed in the hole; wherein: (a) two or more elongated slots through the cylindrical wall extend from a first circumferential collar of the tube to a second circumferential collar of the tube; (b) the two or more slots form two or more elongated resilient legs connecting the first collar and the second collar; and (c) a portion of each elongated leg is disposed in the hole.

DETAILED DESCRIPTION

Figure 1A:
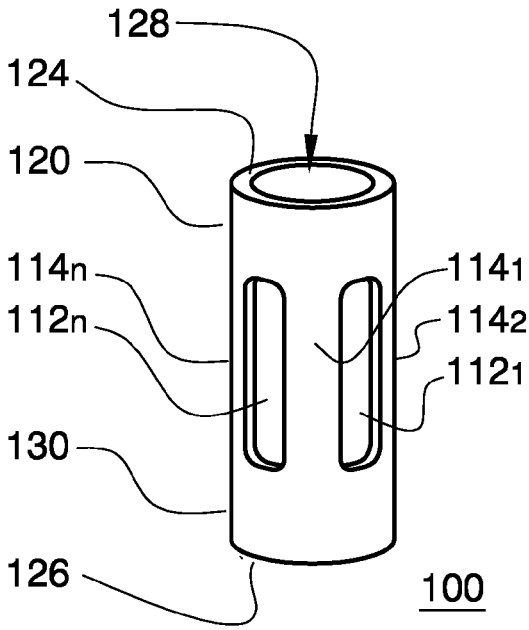
FIG. 1A is a perspective view of an axially compliant electrical contactor.
Figure 1C:
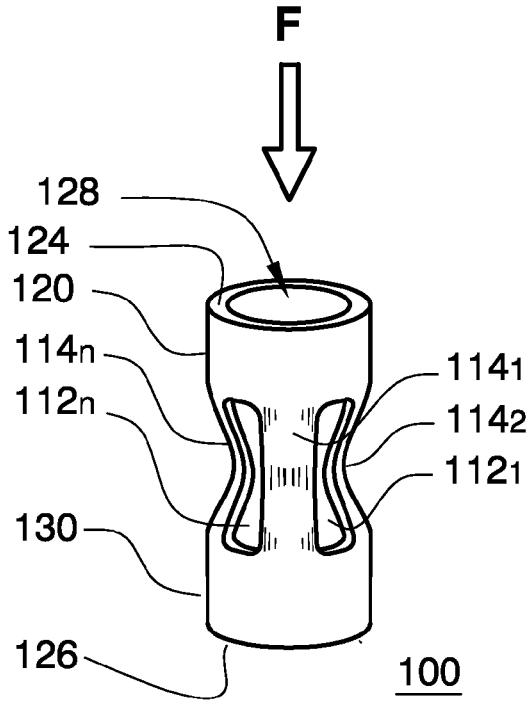
FIG. 1C is a perspective view of the axially compliant electrical contactor shown in FIG. 1A under compression by force F.
Figure 1B:
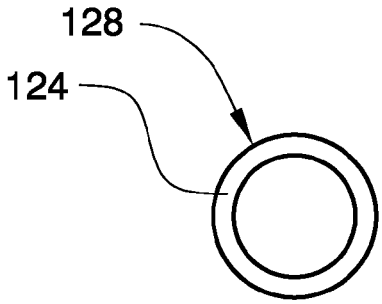
FIG. 1B is a top view of the axially compliant contactor shown in FIG. 1A.

FIG. 1A is a perspective view of axially compliant electrical contactor 100 in a quiescent state before application of mating forces, and FIG. 1B is a top view of axially compliant electrical contactor 100 (the term "contactor" refers to a conductive connector element). In accordance with one or more such embodiments of the present invention, axially compliant electrical contactor 100 is fabricated from cylindrical metal tube 128 (the term "cylindrical tube" or tube refers to a hollow tube with walls parallel to a central axis where a cross section of the tube perpendicular to the central axis may be circular, oblate, squared, rectangular, and so forth). A plurality of contactors 100 may be used in sockets, connectors, and probes that are used to connect corresponding pairs of terminals (the term "terminal" refers to a conductive element (solder bump, copper ball, etc.) on microelectronic devices and components (as used herein, the term device is used in the broadest sense and includes, without limitation, an electronic device and a microelectronic device including a semiconductor chip, semiconductor wafer, a flip chip, a packaged electronic circuit, a hybrid circuit, a daughter card, a multi-chip module, and the like). As shown in FIG. 1A, cylindrical metal tube 128 includes top end 124, bottom end 126, and a wall of metal tube 128 that is cut through by an array of elongated slots $\mathbf{112}_1$ to $\mathbf{112}_n$ (the term "slots" refers to elongated cuts through the wall of tube 128), which array of slots forms a corresponding array of resilient elongated legs $\mathbf{114}_1$ to $\mathbf{114}_n$ connected at one end to cylindrical collar 120 and at a second end to cylindrical collar 130 (the term "leg" refers to one of the contactor links along the wall of the tube and the term "resilient" refers to elastically deformable). In a quiescent state shown in FIGS. 1A and 1B, each of legs $\mathbf{114}_1$ to $\mathbf{114}_n$ is substantially equidistant from an axis of tube 128 along the length of the leg. The top view of contactor 100 in the quiescent state shown in FIG. 1B shows top end 124 of tube 128 and none of legs $\mathbf{114}_1$ to $\mathbf{114}_n$ is seen in FIG. 1B to project substantially away from a surface of the wall toward the axis than the body of tube 128. As shown in FIG. 1A, contactor 100 is a contactor with two equivalent ends. In accordance with one or more embodiments of the present invention, and as shown in FIG. 1A, end 124 and/or end 126 may have erose ends (for example, cut in a sawtooth pattern) to better contact with a terminal. However, it should be understood that further embodiments may be fabricated where this is not the case, and the two ends may not be equivalent.

Dimensions of contactor 100 for a particular embodiment depend upon design issues such as, for example and without limitation, a spacing between adjacent contactors in a socket, signal impedance, total current carried by a contactor, and a range of axial compliance required of the contactor. One or more embodiments of axially compliant contactor 100 may be fabricated from hypodermic 304 stainless steel tubing available from K-Tube Corporation, Poway, Calif. 92064, in sizes ranging, for example and without limitation, from an outer diameter of 0.025 millimeter to 5.0 millimeters. In accordance with one or more such embodiments, slots $\mathbf{112}_1$ to $\mathbf{112}_n$ are cut through the cylindrical wall of tube 128 using a fiber optic laser. By way of example, slots $\mathbf{112}_1$ to $\mathbf{112}_n$ are shown as straight slots aligned parallel to the axis of tube 128. However, embodiments of the present invention are not limited to such a configuration, and further embodiments of the present invention include one or more of the elongated legs along a length of tube 128 that are curved or have some further shapes such as an "S" or a saw tooth or a helical shape (for example, elongated legs formed by helical slots cut lengthwise along a midsection of the tube), and so forth. In addition, still further embodiments of the present invention include one or more elongated legs whose width varies along the length of the leg so that, for example and without limitation, the width of the leg is different at least two positions along the slot. The length of elongated legs $\mathbf{114}_1$ to $\mathbf{114}_n$ is preferably greater than ten times the minimum width of a leg, as measured in the axial direction, although lengths outside this range may be suitable for legs of different shapes. In accordance with one or more further such embodiments, after slots $\mathbf{112}_1$ to $\mathbf{112}_n$ are formed, tube 128 may be plated with, for example and without limitation, about 0.010 millimeters of copper, and then plated with about 0.02 millimeters of nickel and about 0.001 millimeters of hard gold. Those of ordinary skill in the art will readily understand that contactor 100 may be made using alternative processing methods including, without limitation, pattern plating, photolithographic etching, mandrel plating and sputter ion deposition. It will also be understood by those of ordinary skill in the art that metals other than stainless steel 304 may be used for the tube 128. By way of example and without limitation, nitinol (Ni/Ti alloys), Monel, tungsten, tungsten alloys, nickel-cobalt alloys, nickel-tungsten alloys, 440C steel, beryllium-copper alloys, multi-layer metals, and other metals may be used. In accordance with one or more such embodiments, coatings may be applied to a contactor to increase its conductivity or to increase its resilience. For example, nickel-copper-gold plating or silver plating increases the conductance of the contactor, and a thin plating of nickel-cobalt alloy improves its resilience.

Figure 1D:
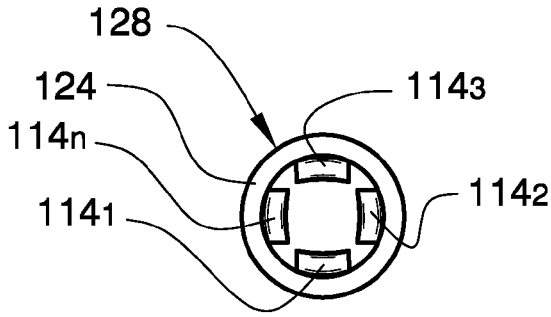
FIG. 1D is a top view of the axially compliant electrical contactor shown in compression in FIG. 1C.

FIG. 1C is a perspective view of axially compliant electrical contactor 100 under compression by force F applied in an axial direction to end 124 of contactor 100. FIG. 1D is a top view of axially compliant electrical contactor 100 shown under compression. As shown in FIGS. 1C and 1D, resilient legs $\mathbf{114}_1$ to $\mathbf{114}_n$ flex inward toward the axis of tube 128 (where the term "flex inward" means a deflection having a component of motion toward the axis of the tube). The top view of FIG. 1D shows legs $\mathbf{114}_1$ to $\mathbf{114}_n$ extending inwardly toward the center of tube 128 where the term "extending inwardly toward the center" means that movement of a point on a resilient leg has a substantial component of motion toward the axis of tube 128. In accordance with one or more embodiments of the present invention, flexure of elongated legs $\mathbf{114}_1$ to $\mathbf{114}_n$ causes foreshortening of contactor 100 in an axial direction, thereby decreasing the length of contactor 100 as measured from first end 124 to second end 126, and in turn, such foreshortening of cylindrical tubular contactor 100 under axial force F provides axial compliance to the contactor. One of ordinary skill in the art will readily understand that a contactor with two or more elongated legs will operate in a similar manner to operation of contactor 100 shown with four elongated legs in FIGS. 1A to 2B.

Elongated legs $\mathbf{114}_1$ to $\mathbf{114}_n$ of FIGS. 1C and 1D are shown deformed or flexed inwardly toward the axis of tube 128. Elongated legs $\mathbf{114}_1$ to $\mathbf{114}_n$ may also deform or flex outwardly away from the axis of tube 128, causing interference and possible electrical short circuits to adjacent contactors. Proper operation of one or more embodiments of the invention requires inward flexure of elongated legs $\mathbf{114}_1$ to $\mathbf{114}_n$. It was discovered that use of an insulative sleeve enclosing a portion of the length of legs $\mathbf{114}_1$ to $\mathbf{114}_n$ prevents outward flexure of the legs without interfering with axial compliance of contactor 100. The sleeve directs flexure of each leg $\mathbf{114}_n$ inwardly without causing the leg to jam against the sleeve and lock contactor 100 in place, thereby opposing axial resilience. This aspect of one or more embodiments of the invention is illustrated in the cross sectional views of FIGS. 2A and 2B.

Figure 2A:
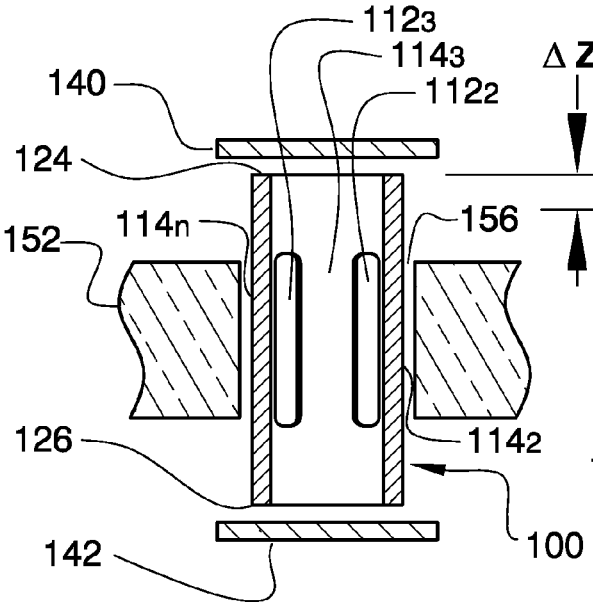
FIG. 2A is a cross section of a portion of an electrical contactor that is fabricated in accordance with one or more embodiments of the present invention.
Figure 2B:
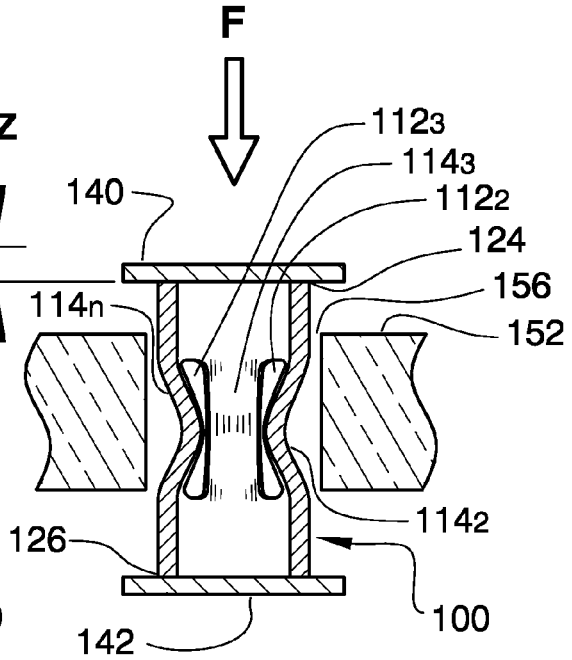
FIG. 2B is a cross section of the portion of an axially compliant electrical contactor shown in FIG. 2A under compression by force F.

FIG. 2A is a cross section of a portion of an electrical contactor assembly that is fabricated in accordance with one or more embodiments of the present invention (a typical use of axially compliant contactor 100 in a socket for microelectronic devices is shown in cross sectional FIG. 2A). FIG. 2A shows contactor 100 in a quiescent state wherein no axial forces are applied to ends 124 and 126 thereof. As further shown in FIG. 2A, contactor 100 is disposed in, and held in position by, hole 156 through insulative sheet 152, end 124 is juxtaposed to mating terminal 140, and end 126 is juxtaposed to mating terminal 142 (in this embodiment, insulative sheet 152 provides an insulative sleeve for contactor 100). Contactor 100 is slidably disposed in hole 156 wherein legs $\mathbf{114}_1$ to $\mathbf{114}_n$ are constrained from flexing substantially outwardly over a portion of the length of each leg $\mathbf{114}_n$. FIG. 2B is a cross section of the portion of an electrical contactor assembly shown in FIG. 2A under compression by force F when contactor 100 engaged so that terminal 140 is urged by force F in an axial direction toward terminal 142. As a result, contactor 100 is axially compressed and makes a good electrical connection between terminals 140 and 142. Compression of contactor 100 causes resilient legs $\mathbf{114}_1$ to $\mathbf{114}_n$ to deflect inwardly toward the axis of contactor 100, thereby foreshortening contactor 100 by an axial displacement shown in FIG. 2B as $\Delta Z$. Deflection of elongated legs $\mathbf{114}_1$ to $\mathbf{114}_n$ is guided inwardly by hole 156 encircling a portion of the length of each leg $\mathbf{114}_n$. Advantageously, compression of contactor 100 provides axial compliance that enables each of the contactors in an array to make positive electrical contact to a corresponding mating terminal.

Figure 2C:
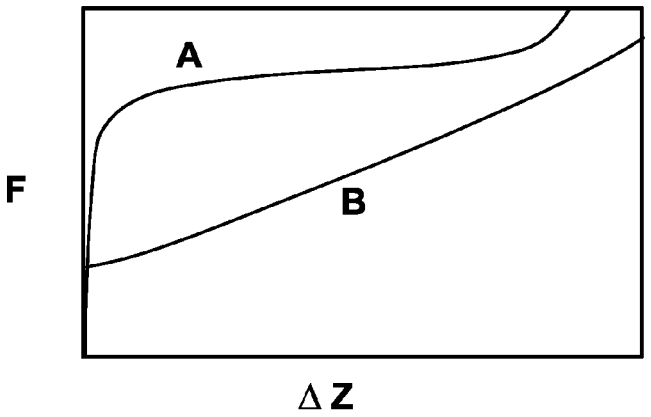
FIG. 2C is a graph of force F vs. axial displacement AZ shown in curve A for an electrical contactor that is fabricated in accordance with one or more embodiments of the present invention, and shown in curve B for a conventional spring pin.

FIG. 2C is a graph of force (F) vs. axial displacement ($\Delta Z$) shown in curve A for an electrical contactor that is fabricated in accordance with one or more embodiments of the present invention, and shown in curve B for a conventional spring pin. As shown in FIG. 2C, force F of curve A rises rapidly with compression above $\Delta Z=0$, and varies more slowly with additional compression $\Delta Z$ thereafter. In comparison, the force needed to compress a spring probe of the Pogo® spring contact type is shown by curve B of FIG. 2C wherein the force increases substantially linearly from an initial preload force as the spring contact is compressed along its axis. As such, it can be readily appreciated that contactor 100 yields an improvement over conventional spring pins of the Pogo® spring contact type by providing a more nearly constant contact force F over the operating range of the contactor than that provided by a conventional spring pin.

In accordance with one or more embodiments of the present invention, terminals 140 and 142 are shown in FIGS. 2A and 2B as flat metal pads, typically comprising a layer of copper metal on an epoxy circuit board substrate. However, in accordance with one or more further embodiments, terminals 140 and 142 may be BGA solder bumps, metal balls, wafer pads, leadframe leads, or other terminals used in microelectronics devices (and terminal 140 and 142 may be different). In accordance with one or more embodiments of the present invention, contactor 100 may be attached permanently to one or both of terminals 140 and 142 using methods that are well known in the art including, without limitation, soldering, laser welding, spark welding, thermo-compression bonding, diffusion bonding, thermo-sonic bonding, ultrasonic bonding and the like.

As has been described above, and in accordance with one or more embodiments of the present invention, a contactor comprises a hollow cylindrical metal tube having an array of lengthwise elongated slots through the wall of the tube wherein (a) the array of slots forms a plurality of elongated resilient metallic legs and (b) each of the resilient legs is connected to a first cylindrical collar (the term "cylindrical collar" refers to a segment or solid band of the tube that extends around the circumferential girth of the tube and the term "girth" refers to a circumferential distance around the tube) at a first end of the tube and to a second cylindrical collar at a second end of the tube. In accordance with one or more embodiments of the present invention, axial resilience of the contactor is provided by inward flexure of each of the plurality of resilient legs toward the axis of the tube, and such axial resilience acts to provide reliable electrical contact between terminals urged axially into contact with a first end and with a second end of the contactor. In accordance with one or more further embodiments of the present invention, a contactor may comprise more than two circumferential collars interconnected by elongated resilient legs thereby forming a plurality of axially compliant segments of the contactor.

In accordance with one or more embodiments, initially, in a quiescent state, each leg falls substantially within a surface contour of the metal tube. Then, during operation of a contactor, a metallic terminal is urged into contact with each end of the tube, causing the contactor to compress in a direction along the axis of the tube by inward flexure of the resilient legs in the wall of the tube. The contactor may also be compliant in a bending mode wherein the axis of the tube is curved by a terminal being urged radially against an end of the tube.

Sockets for microelectronic devices typically have a plurality of contactors disposed in an array of apertures formed through an insulative holder. By way of example and without limitation, a high performance socket may incorporate a plurality of contactors 100, each of which is held in an array of holes 156 through holder plate 152 comprising a dielectric sheet. In accordance with one or more such embodiments of the present invention, the material of the dielectric sheet is selected from a group of dimensionally stable polymer materials including, without limitation: glass reinforced Torlon 5530 available from Quadrant Engineering Plastic Products, Inc. of Reading, Pa.; Vespel; Ultem 2000 available from GE Company GE Plastics of Pittsfield, Mass.; PEEK; liquid crystal polymer; and others. Further, in accordance with one or more such embodiments, holder plate 152 may comprise a plurality of layers including metals, polymers, woven glass layers, aramid fiber layers, and the like. Still further, in accordance with one or more such embodiments, one or more of the layers of insulative sheet 152 may have features that engage contactor 100 and retain it in the holder plate. By way of example, and in accordance with one or more such embodiments, a layer of insulative sheet 152 my urge against legs $\mathbf{114}_1$ to $\mathbf{114}_n$, thereby biasing them inwardly away from their initial position in the quiescent state, and thereby holding contactor 100 within sheet 152.

Figure 3A:
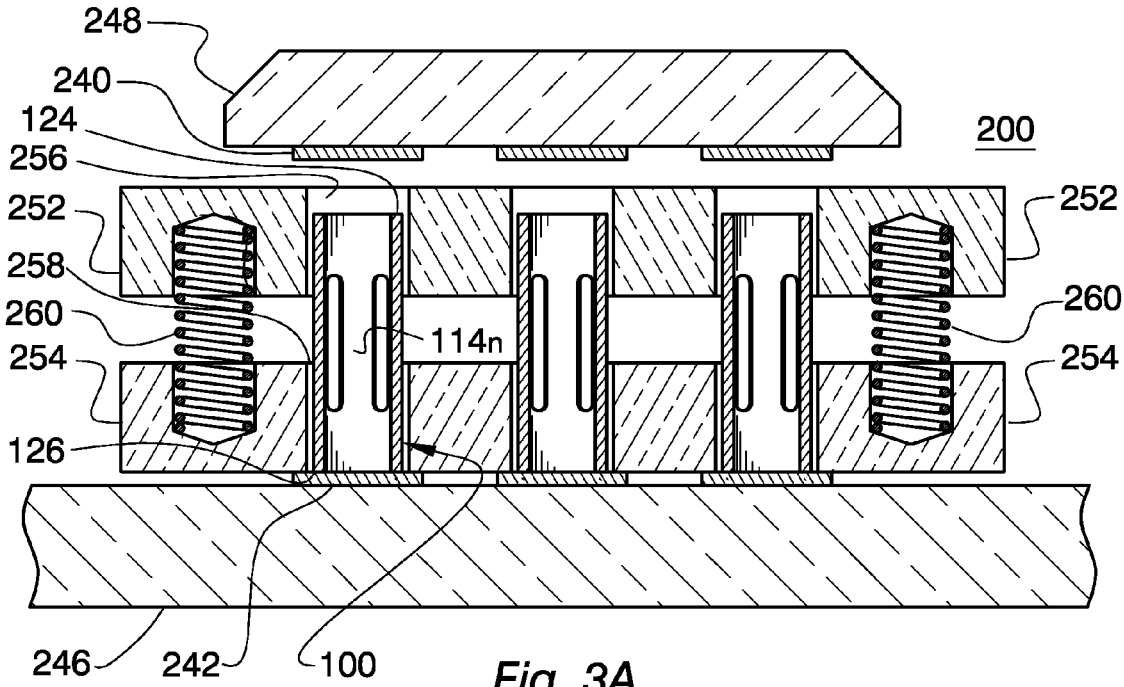
FIGS. 3A and 3B are cross sectional views of an electrical contactor assembly that is fabricated in accordance with one or more embodiments of the invention where the assembly is shown before and after engagement with an LGA device, respectively.
Figure 3B:
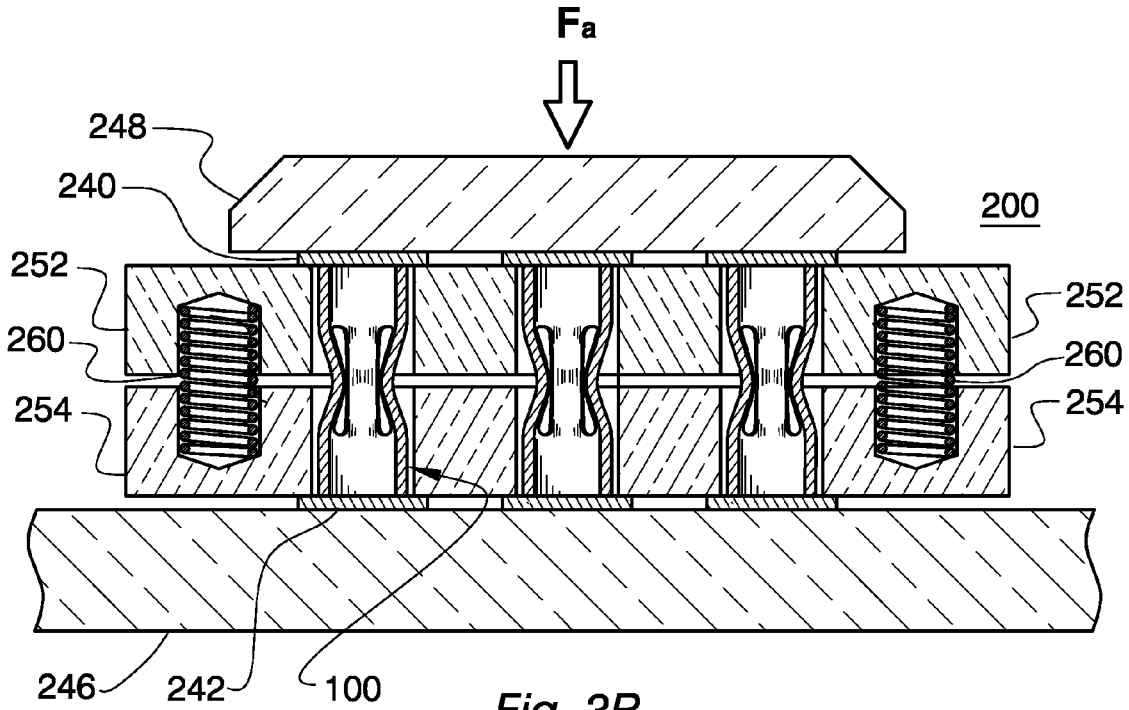

FIGS. 3A and 3B show contactor assembly 200 which is adapted to connect terminals 240 on device 248 to corresponding pads 242 on circuit board 246. FIG. 3A shows device 248 juxtaposed to contactor assembly 200 before mating, and FIG. 3B shows device 248 urged into contact with contactor assembly 200 by force $F_a$. Contactor assembly 200 is representative of a use of axial compliant contactors in an LGA socket. Contactor assembly 200 comprises a body with top insulative sheet 252 and bottom insulative sheet 254 resiliently coupled by springs 260 (in this embodiment, insulative sheet 252 provides a first insulative sleeve for contactors 100 in assembly 200, and insulative sheet 254 provides a second insulative sleeve for contactors 100 in assembly 200). Contactor elements 100 are slidably disposed in holes 256 in top sheet 252 and in holes 258 in bottom sheet 254.

Device 248 in FIG. 3B is urged into contact with contactor assembly 200, thereby connecting terminals 240 with corresponding pads 242 by means of contactors 100. As device 248 is urged into contactor assembly 200 by force $F_a$, top sheet 252 is deflected toward bottom sheet 254 (in a direction substantially along a normal to a surface of sheet 254), thereby compressing resilient springs 260. During deflection of top sheet 252, contactors 100 are exposed at a surface of sheet 252 distal from bottom sheet 254. As shown in FIG. 3B, contactors 100 are axially compressed wherein force is exerted by contactors 100 on terminals 240 and on pads 242, thereby connecting corresponding pairs of terminals 240 to pads 242. As contactors 100 are compressed axially, elongated legs $\mathbf{114}_n$ flex inwardly to accommodate axial compliance, and to provide resilient restoring force opposing compliant compression of the contactors. Elongated legs $\mathbf{114}_n$ are guided to flex inwardly and not outwardly by holes 256 and 258 in sheets 252 and 254, respectively. In order that flexure of elongated legs $\mathbf{114}_n$ is guided inwardly without jamming the legs outwardly against the holes, a minimum cross sectional area of a hole is preferably between 1.0 and 1.5 times an area enclosed by a circumference of a cross section of an outer surface of cylindrical contactor 100. In addition, a portion of the length of each elongated leg is enclosed by hole 256 or hole 258 in one of insulative sheets 252 or 254, respectively.

Figure 4A:
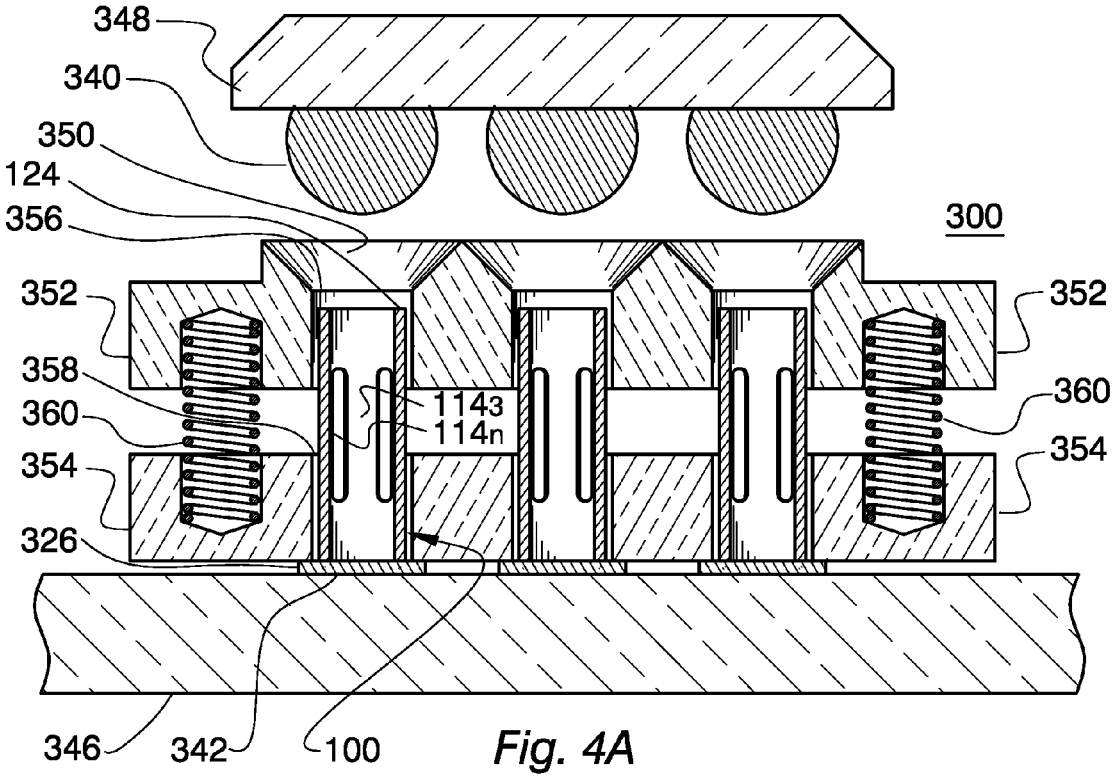
FIGS. 4A and 4B are cross sectional views of an electrical contactor assembly that is fabricated in accordance with one or more embodiments of the invention where the assembly is shown before and after engagement with a BGA device, respectively.
Figure 4B:
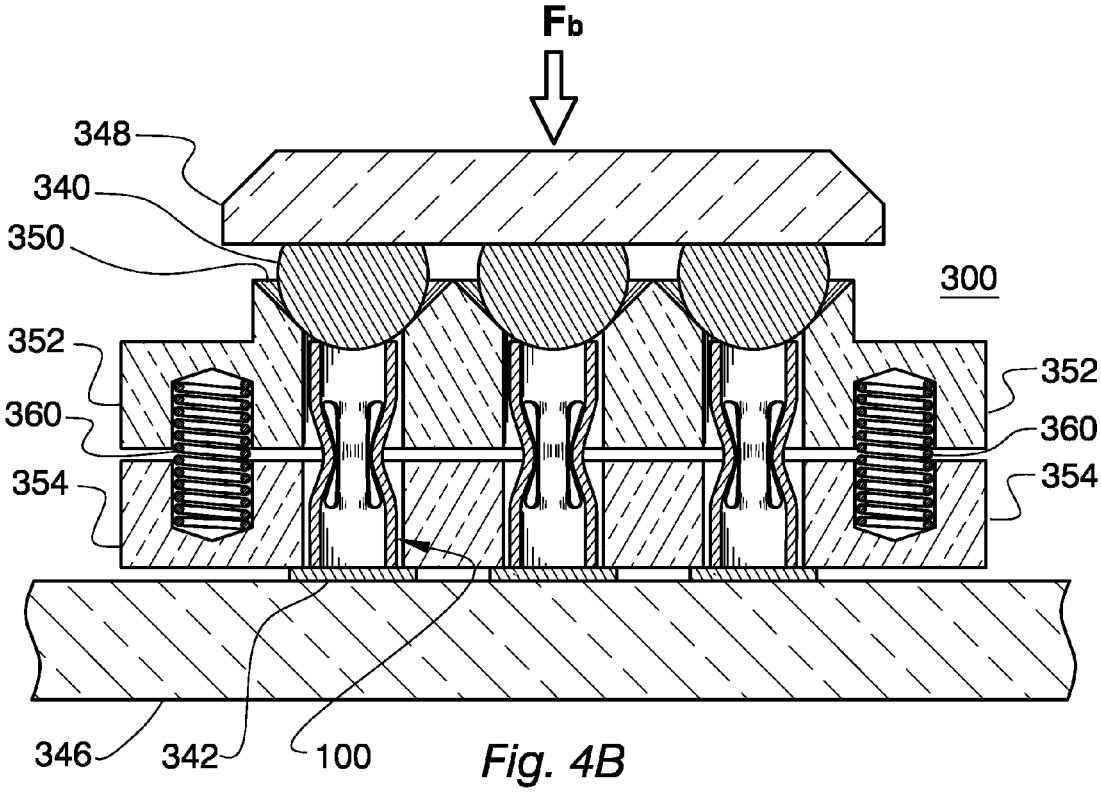

FIGS. 4A and 4B show contactor assembly 300 which is adapted to connect bulbous terminals 340 on device 348 to corresponding pads 342 on circuit board 346. FIG. 3A shows BGA device 348 juxtaposed to contactor assembly 300 before mating, and FIG. 3B shows BGA device 348 urged into contact with contactor assembly 300 by force $F_b$. Contactor assembly 300 is representative of a use of axial compliant contactors in a BGA socket. Contactor assembly 300 comprises a body with top insulative sheet 352 and bottom insulative sheet 354 resiliently coupled by springs 360. Contactor elements 100 are slidably disposed in holes 356 in top sheet 352 and in holes 358 in bottom sheet 354 (in this embodiment, insulative sheet 352 provides a first insulative sleeve for contactors 100 in assembly 300, and insulative sheet 354 provides a second insulative sleeve for contactors 100 in assembly 300). Top insulative sheet 252 is provided with conical holes 350 at a top surface distal to bottom insulative sheet 254. Conical holes 350 act to guide registration of balls 340 on BGA device 348 as device 348 is brought into engagement with contactor assembly 300.

BGA device 348 of FIG. 4B is urged into contact with contactor assembly 300, thereby connecting ball terminals 340 with corresponding pads 342 by means of contactors 100. As BGA device 348 is urged into contactor assembly 300 by force $F_b$, bulbous terminals 340 are centered in conical sections 350 of holes 356 through top sheet 352. Force $F_b$ urges ball terminals 340 of BGA device 348 into conical sections 350, thereby deflecting top sheet 352 toward bottom sheet 354 (in a direction substantially along a normal to a surface of sheet 354) and compressing resilient springs 360. During deflection of top sheet 352, contactors 100 are exposed to BGA balls 340. As shown in FIG. 4B, contactors 100 are axially compressed, whereby force is exerted by contactors 100 on bulbous terminals 340 and on pads 342, thereby connecting corresponding pairs of terminals 340 to pads 342. As contactors 100 are compressed axially, elongated legs $\mathbf{114}_n$ flex inwardly to accommodate axial compliance, and to provide resilient restoring force opposing compliant compression of the contactors. Elongated legs $\mathbf{114}_n$ are guided to flex inwardly and not outwardly by holes 356 and 358 in sheets 352 and 354, respectively. In order that flexure of elongated legs $\mathbf{114}_n$ is guided inwardly without jamming the legs outwardly against the holes, a minimum cross sectional area of a hole is preferably between 1.0 and 1.5 times an area enclosed by a circumference of a cross section of an outer surface of cylindrical contactor 100. In addition, a portion of the length of each elongated leg is enclosed by hole 356 or hole 358 in one of insulative sheets 352 or 354, respectively.

Embodiments of the present invention described above are exemplary. As such, many changes and modifications may be made to the description set forth above by those of ordinary skill in the art while remaining within the scope of the invention. In addition, materials, methods, and mechanisms suitable for fabricating embodiments of the present invention have been described above by providing specific, non-limiting examples and/or by relying on the knowledge of one of ordinary skill in the art. Materials, methods, and mechanisms suitable for fabricating various embodiments or portions of various embodiments of the present invention described above have not been repeated, for sake of brevity, wherever it should be well understood by those of ordinary skill in the art that the various embodiments or portions of the various embodiments could be fabricated utilizing the same or similar previously described materials, methods or mechanisms. As such, the scope of the invention should be determined with reference to the appended claims along with their full scope of equivalents.

What is claimed is:

1. An axially compliant electrical contactor for interconnecting microelectronic devices, the contactor comprising:

an insulative sleeve having a hole therethrough; and a metal tube having a cylindrical wall being slidably disposed in the hole;

wherein:

two or more elongated slots through the cylindrical wall extend from a first circumferential collar of the tube to a second circumferential collar of the tube;

the two or more slots form two or more elongated resilient legs connecting the first collar and the second collar; and a portion of each elongated leg is disposed in the hole; and wherein the metal tube is disposed in a hole in another insulative sleeve, and the sleeve is resiliently movable with respect to the another sleeve in a direction along a normal to a surface of the first sleeve.

2. An electrical contactor for interconnecting terminals on a first microelectronic device to corresponding terminals on a second microelectronic device, the contactor comprising:

a first insulative sheet having a first array of holes therethrough;

a second insulative sheet having a second array of holes therethrough; and a plurality of axially compliant metal tubes, each being slidably disposed in a hole through the first sheet and being disposed in a hole in the second sheet;

wherein the first sheet is resiliently coupled to the second sheet by a plurality of springs.

3. The electrical contactor of claim 2 wherein one or more of the axially compliant metal tubes have two or more slots through a wall of the one or more tubes along a portion of the length of the one or more tubes.

4. The electrical contactor of claim 2 wherein holes in the first insulative sheet have a conical opening on a surface distal from the second insulative sheet.

* * * * *